US009022143B2

(12) United States Patent
Dupont et al.

(10) Patent No.: US 9,022,143 B2
(45) Date of Patent: May 5, 2015

(54) WEAR INDICATORS FOR DRILLING EQUIPMENT

(75) Inventors: Olivier Dupont, Saint-Ghislain (BE); Nuno Da Silva, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/513,533

(22) PCT Filed: Jun. 3, 2011

(86) PCT No.: PCT/EP2011/059203
§ 371 (c)(1),
(2), (4) Date: Nov. 28, 2012

(87) PCT Pub. No.: WO2012/163431
PCT Pub. Date: Dec. 6, 2012

(65) Prior Publication Data
US 2014/0102791 A1 Apr. 17, 2014

(51) Int. Cl.
*E21B 12/02* (2006.01)

(52) U.S. Cl.
CPC ..... *E21B 12/02* (2013.01)

(58) Field of Classification Search
CPC ..... E21B 12/02
USPC ..... 175/39, 420.1, 426
See application file for complete search history.

(56) References Cited

U.S. PATENT DOCUMENTS

| | | | | |
|---|---|---|---|---|
| 360,905 | A * | 4/1887 | Pathie | 164/2 |
| 2,468,905 | A | 5/1949 | Warren | 255/61 |
| 3,363,702 | A | 1/1968 | Bielstein | 175/39 |
| 5,388,331 | A * | 2/1995 | Doroodian-Shoja Siamak | 30/41.7 |
| 6,167,833 | B1 | 1/2001 | Caraway | 116/208 |
| 2007/0215389 | A1 | 9/2007 | Da Silva et al. | 175/331 |
| 2009/0004449 | A1 * | 1/2009 | Ban et al. | 428/216 |

OTHER PUBLICATIONS

International Search Report and Written Opinion, Application No. PCT/EP2011/059203, 7 pages, Feb. 1, 2012.
International Preliminary Report on Patentability; PCT/EP2011/059203; pp. 6, Dec. 19, 2013.
Chinese Office Action; Application No. 201180071402.5; pp. 8, Nov. 2, 2014.

* cited by examiner

*Primary Examiner* — Cathleen Hutchins
(74) *Attorney, Agent, or Firm* — Baker Botts L.L.P.

(57) ABSTRACT

Described herein is a wear indicator (100) for use in a drill bit or a core head. The wear indicator (100) comprises an elongate element that forms part of the drill bit. The elongate element has a plurality of numbers (110, 120, 130, 140, 150, 160, 170, 180) formed along its length, each number (110, 120, 130, 140, 150, 160, 170, 180) being formed as a void and corresponds to a level of wear in accordance with the IADC dull grading system. As the drill becomes worn, the wear indicator (100) wears at the same rate to reveal one of the numbers (110, 120, 130, 140, 150, 160, 170, 180). The numbers range from "1" to "8" where the number "1" illustrates the least wear and the number "8" indicates the most wear. When unworn, none of the numbers are visible.

23 Claims, 10 Drawing Sheets

WEAR INDICATORS FOR DRILLING EQUIPMENT

CROSS REFERENCE TO RELATED APPLICATIONS

This application is a U.S. National Stage Application of International Application No. PCT/EP2011/059203 filed Jun. 3, 2011, which designates the United States, and which is incorporated herein by reference in its entirety.

FIELD OF THE INVENTION

The present invention relates to wear indicators for drilling equipment, and is more particularly, although not exclusively, concerned with wear indicators for drill bits having a fixed cutting structure and core heads used in drilling operations.

BACKGROUND

Two classes of drilling tools are used in oil drilling, namely, roller-cone bits and fixed-cutter bits. Roller-cone bits have moving parts whilst fixed-cutter bits are mono-block without any moving parts.

Drill bits with fixed cutting structures fall into four sub-categories according to the nature of their cutters. Such cutters can be made of polycrystalline diamond compacts (PDC), natural diamonds, thermally stable polycrystalline diamond (TSP) or a metal-based material impregnated with diamonds or other abrasive particles. This last category is generally termed as "impregnated" bits.

A method of manufacturing a drill bit with a fixed cutting structure is described in U.S. Pat. No. 7,621,349. The fixed cutting structure is made from a metal-based material impregnated with diamonds or other abrasive materials.

It is necessary to be able to assess the level of wear of drill bits with fixed cutting structures so that it is possible to determine their effectiveness when used in a drilling operation. However, it can be difficult to obtain a wear assessment for drill bits, in general, in terms of a wear level at stages of operation. Cutting structure wear is normally determined in accordance with standards set by the International Association of Drilling Contractors (IADC). The relevant standard, the IADC dull grading system, determines the amount of wear of a drill bit in accordance with the height of its original cutting structure. For PDC cutting structures, the height is determined by the diameter of the PDC cutters themselves compared to their original diameter. For impregnated bits, cutting structure height is determined as the blade height measured on the nose area parallel to the main bit axis, the nose area being defined by the tip of the blade profile. A grading system of "1" to "8", representing 0% to 100% wear is used in accordance with the measured PDC cutter or blade height depending on the type of cutting structure. However, as the determination of wear depends on a measurement, it can be inconsistent and therefore unreliable, particularly as when worn, it is impossible to determine the original blade height for impregnated bits.

U.S. Pat. No. 6,167,833 describes a wear indicator for use with rotary drilling tools. The wear indicator is incorporated into a leading surface of the tool and comprises at least one area of visually distinct material that is arranged to indicate progressive wear of the leading surface. The visually distinct material is different to the material from which the drilling tool is mainly composed. The wear indicator may be a embedded in outer surface portions in a graduated way. For example, the wear indicator may comprise: a step arrangement, in which each step indicates the progression of wear of the bit; a wedge arrangement, in which portions of the wedge are exposed in accordance with wear of the tool in which it is embedded; or a plurality of fins, in which the number of exposed fins is an indication of the amount of wear. The wear indicator may comprise stainless steel, brass, aluminium, tungsten, graphite or a ceramic material.

However, the wear indicator described in U.S. Pat. No. 6,167,833 suffers from the disadvantage that, unless one is familiar with the particular wear indicator and how it progresses during the lifetime of the tool in which it is embedded, the determination of the amount of wear may be less than accurate.

SUMMARY OF THE INVENTION

It is therefore an object of the present invention to provide a new wear indicator for fixed surface drilling bits and/or core heads.

It is another object of the present invention to provide a drill bit and/or core head incorporating such a wear indicator.

In accordance with a first aspect of the present invention, there is provided a wear indicator for drilling equipment, the wear indicator comprising an elongate element having a plurality of regions formed along its length, each region having a number formed within it that is indicative of the level of wear.

By having regions with numbers formed in them, an indication of wear can be readily determined without the need to make any measurements.

The elongate element may comprise eight regions, each region being numbered between "1" and "8". In this case, each number can be made to correspond to the numbers used in the IADC dull grading system. This means that there is no need for interpretation as each number corresponds to a respective one of the wear levels in the IADC dull grading system.

Moreover, as it is preferred that each number comprises a void, the numbered regions are still discernible even if they become filled with debris from the drilling operation. The term "void" as used herein refers to the numbers being defined by empty portions within the wear indicator.

Ideally, the elongate element may comprise a closed end that is indicative of no wear. This means that an unworn drill bit can easily be identified. Alternatively, the elongate element may comprise an open end having the number "0" formed therein that is indicative of no wear.

Ideally, the number, if not comprising a void, should be visually distinct with respect to the elongate element. In one embodiment, the number may comprise a different material to that of the elongate member. Alternatively, the number may be of the same material as the elongate element but is textured or coloured to provide the visual distinctiveness.

For ease of manufacture, the elongate element may be substantially cylindrical. The term "cylindrical" refers to a shape having substantially the same cross-section along its length. In this respect, the elongate element may have a substantially circular, elliptical or rectangular cross-section. The elongate element may also have a substantially polygonal cross-section, preferably, the cross-section of a regular polygon. In this case, the cross-section may be square, triangular, or even hexagonal.

Each region may be formed as a discrete portion and the portions are held together to form the elongate element. The portions may be fused together before insertion into the drill bit, or may be fused together as part of the moulding process for the drill bit, for example, during an infiltration process used for the manufacture of impregnated bits. Alternatively, each region may be formed consecutively in a continuous process.

In accordance with another aspect of the present invention, there is provided a drill bit including a wear indicator as described above.

In accordance with a further aspect of the present invention, there is provided a core head including a wear indicator as described above.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 2:
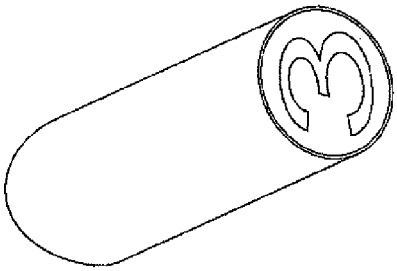
FIG. 2 illustrates a perspective view of a wear indicator in accordance with the present invention, the wear indicator showing level "3" wear.

The present invention will be described with respect to particular embodiments and with reference to certain drawings but the invention is not limited thereto. The drawings described are only schematic and are non-limiting. In the drawings, the size of some of the elements may be exaggerated and not drawn on scale for illustrative purposes.

It will be understood that the terms "vertical" and "horizontal" are used herein refer to particular orientations of the Figures and these terms are not limitations to the specific embodiments described herein.

In a preferred embodiment of the present invention, a wear indicator is provided that comprises a series of numbers which indicate the level of wear of a drill bit and/or a core head. Each number is made as a void formed in the wear indicator. The numbers are still discernible even if the void forming the number is filled with cuttings from the drilling process. Ideally, these numbers correspond to respective wear levels indicated on the IADC dull grading system.

For each wear indicator, its length is approximately divided by eight so that the number visible indicates the level of wear of the drill bit or core head in which the wear indicator is located, for example, "1" indicates level "1" wear and "8" indicates level "8" wear. Whilst the unworn state can be indicated by a closed end of the wear indicator, it is also possible to indicate the unworn state with the number "0". In this case, it may be necessary to divide the length of the wear indicator by nine instead of eight to indicate the corresponding wear levels. In many instances, this choice will depend on the original cutting structure height as well as the type of drill bit in which the wear indicator is inserted. In addition, the spacing between the numbers will also depend on the specific drill bit design. Described below is a wear indicator for an impregnated bit, but it will be appreciated that it can be applied to any fixed cutting structure drill bit, for example, PDC bits.

Figure 1:
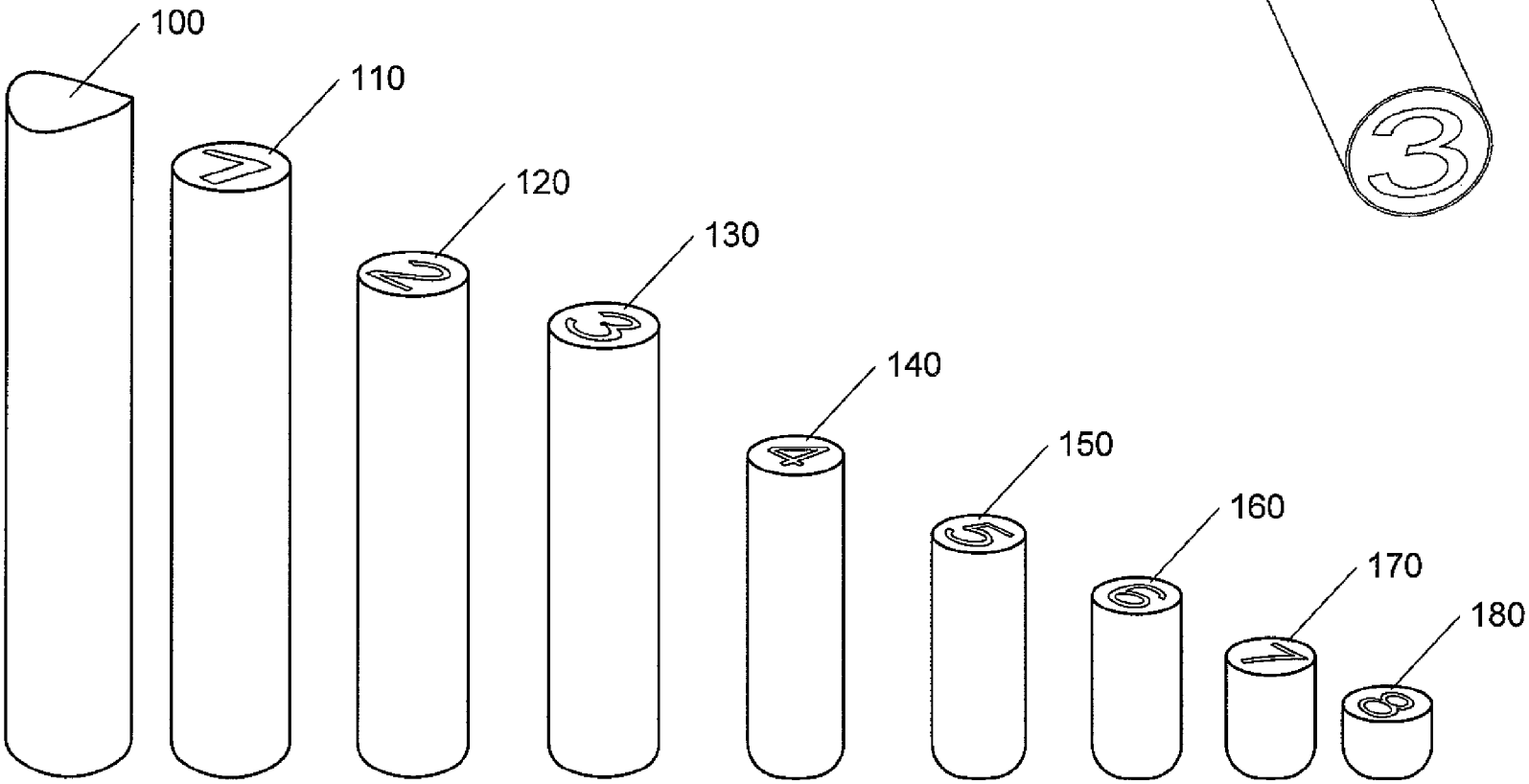
FIG. 1 illustrates a wear indicator concept in accordance with the present invention.

Referring initially to FIG. 1, a chart illustrates the stages of a wear indicator in accordance with the present invention. The wear indicator comprises an elongate element, for example, a rod of steel, that has been made using rapid prototyping and/or rapid manufacturing methods. Other manufacturing methods can also be used as described below. A new wear indicator 100 is shown where no numbers are visible. Wear indicators 110, 120, 130, 140, 150, 160, 170, 180 are also shown that illustrate different levels of wear, each wear indicator corresponding to wear levels "1" to "8" respectively. In each of the wear indicators 110, 120, 130, 140, 150, 160, 170, 180, the relevant number corresponding to the wear level is visible. As described above, each of the numbers is formed as a void within the relevant portion of the rod. Alternatively, the numbers may be made of another material that is visually distinct from the body of the wear indicator 100.

Although FIG. 1 shows the numbers as being complete numbers, it may be necessary to stylise the number so that they can readily be formed during manufacture of the wear indicator. For example, the section through numbers 4, 6 and 8 may comprise outlines with no enclosed solid portion(s). However, if thin solid dividers are provided between numbers, there will be no need for stylisation.

As described above with reference to FIG. 1, the wear indicator 100 comprises an elongate element comprising eight regions, each one numbered with a number between "1" and "8" in accordance with the IADC dull grading system. However, it will be appreciated that, if it is not necessary to use the IADC dull grading system, the numbers "1" to "8" can be replaced with letters "A" to "H" or even Roman numerals "I" to "VIII". Additionally, the wear indicator may be arranged to show different levels of wear, for example, instead of having eight levels of wear with IADC dull grading system, more or less levels of wear may be allowed for in accordance with the particular application.

FIG. 2 illustrates a wear indicator that has been made from steel using rapid prototyping methods. The indicator has a diameter of 8 mm and a length of 45 mm and has been cut a level that is equivalent to wear level "3". In the case where the numbers on the wear indicator correspond to respective wear levels in the IADC dull grading system, the length of the wear indicator is divided into 8 regions with a closed end that indicates that the drill bit is unworn. However, it will be appreciated that the wear indicator may have different diameters and/or lengths in accordance with the specific bit design.

As described above, the wear indicator comprises an elongate element. However, the elongate element may be cylindrical, that is, having substantially the same cross-section along its length. The cross-section may be substantially circular, elliptical, square or rectangular. If the cross-section is not to be circular, elliptical, square or rectangular, more generally, the elongate element may have a substantially polygonal cross-section, preferably, the cross-section of a regular polygon. In this case, the cross-section may be triangular, hexagonal, octagonal etc.

It will also be appreciated that the elongate element may also comprise an irregular polygonal cross-section to ensure better keying of the wear indicator with respect to the body of the drill bit when the wear indicator is introduced into the drill bit during its manufacturing stage as described below with reference to impregnated bits, or if an interference fit is to be provided between the wear indicator and the cutting structure into which it is to be inserted. In addition, the wear indicator may be retained within the drill bit by brazing, welding, gluing etc. as will readily be appreciated.

Figure 4:
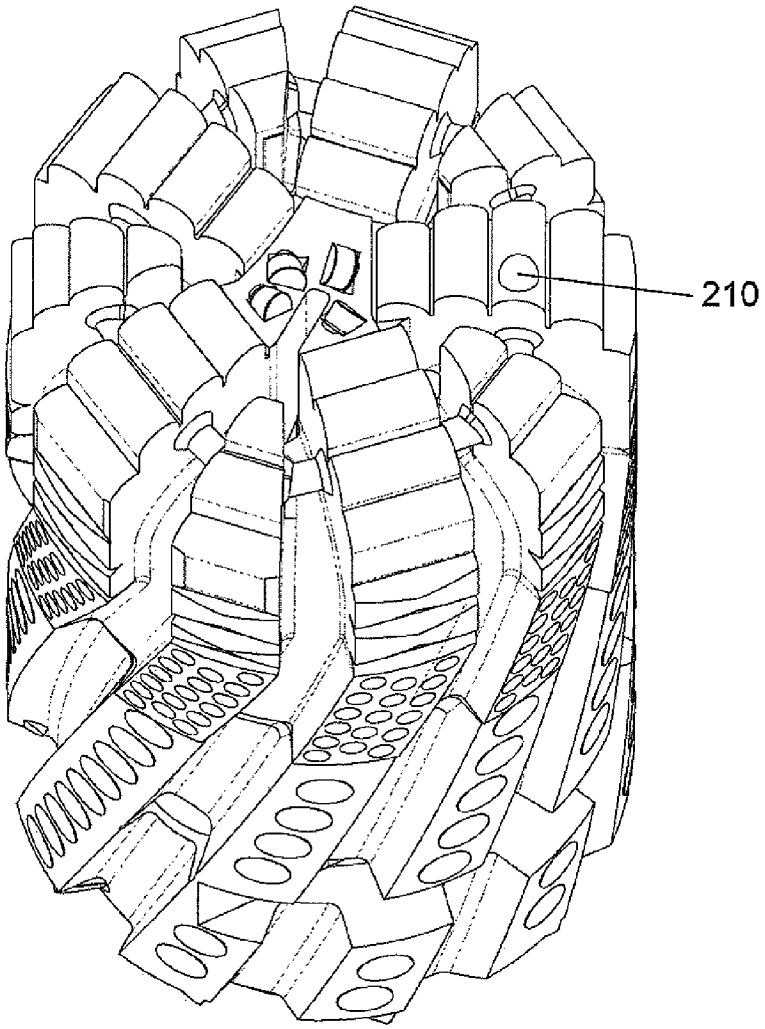
FIGS. 3 and 4 illustrate respectively a top view and a perspective view of an unworn drill bit incorporating a wear indicator in accordance with the present invention.
Figure 3:
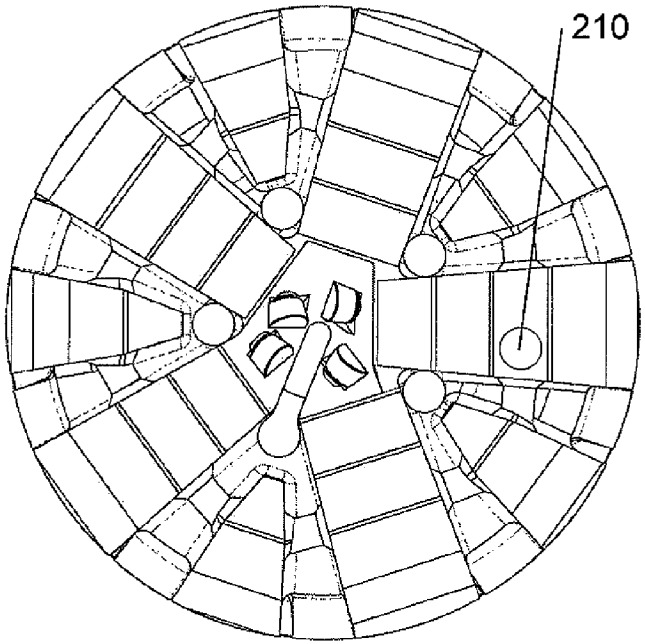

FIGS. 3 and 4 respectively illustrate a top view and a perspective view of a new drill bit in which a wear indicator 210 in accordance with the present invention has been inserted. Here, the bit 200 has not been worn and the wear indicator 210 has its visible end closed so that none of the numbers are displayed. The closure of the visible end may comprise a thin layer of the material from which the wear indicator 210 is made.

Figure 6:
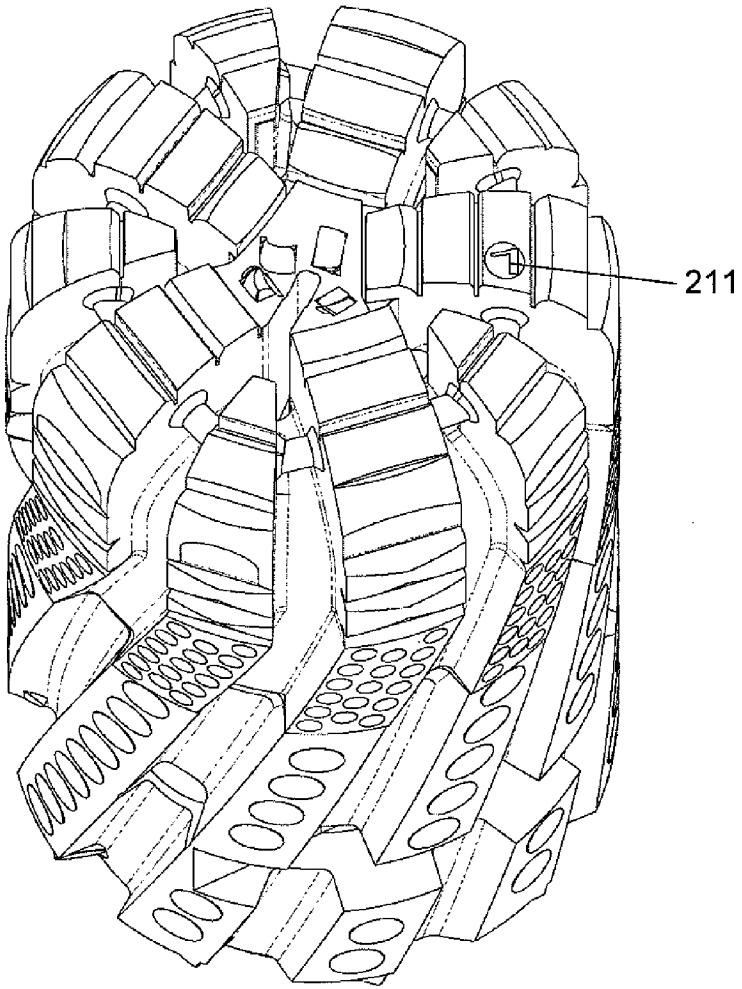
FIGS. 5 and 6 are similar respective ones of FIGS. 3 and 4 but illustrating level "1" wear.
Figure 5:
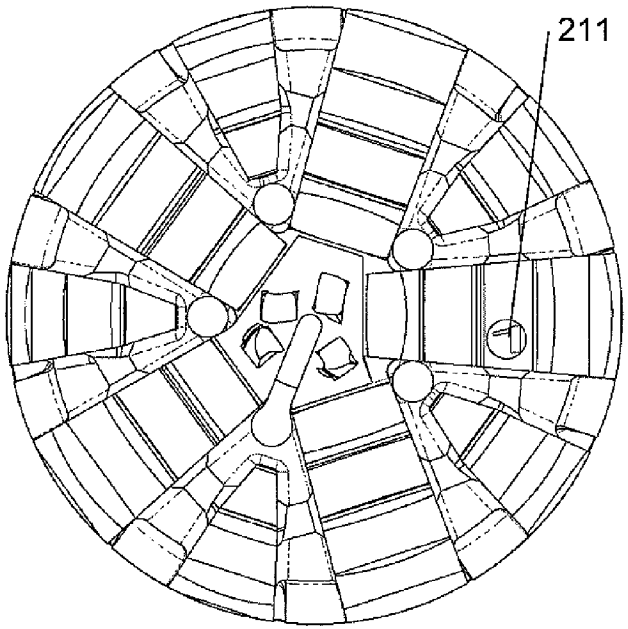
Figure 8:
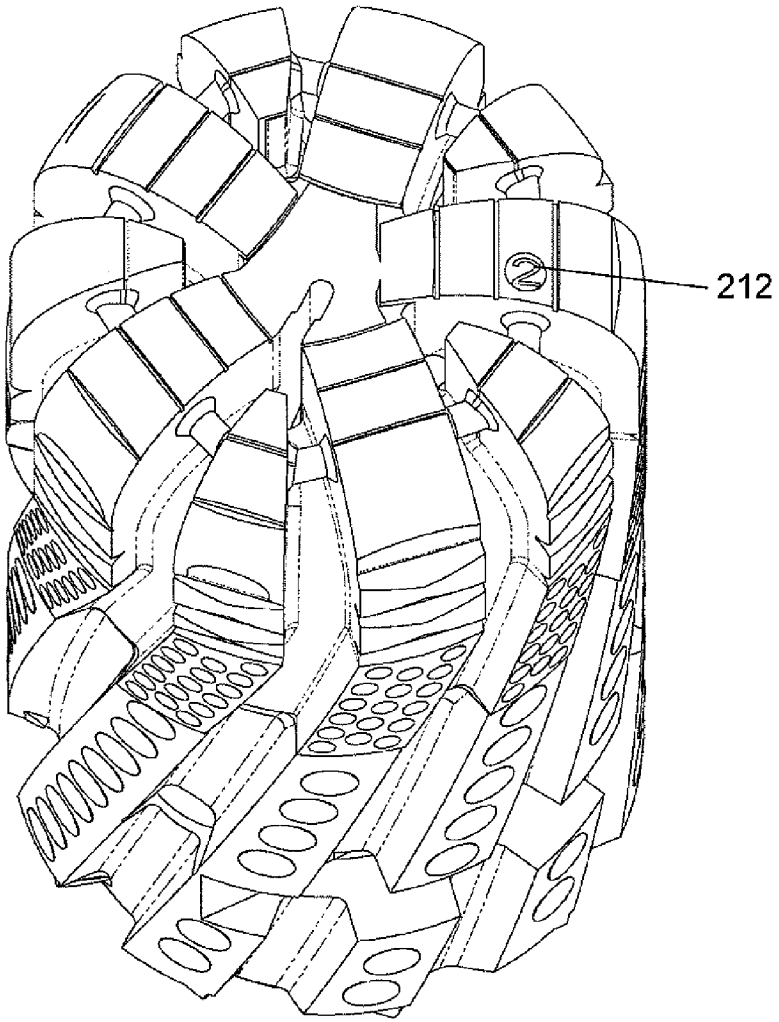
FIGS. 7 and 8 are similar respective ones of FIGS. 3 and 4 but illustrating level "2" wear
Figure 7:
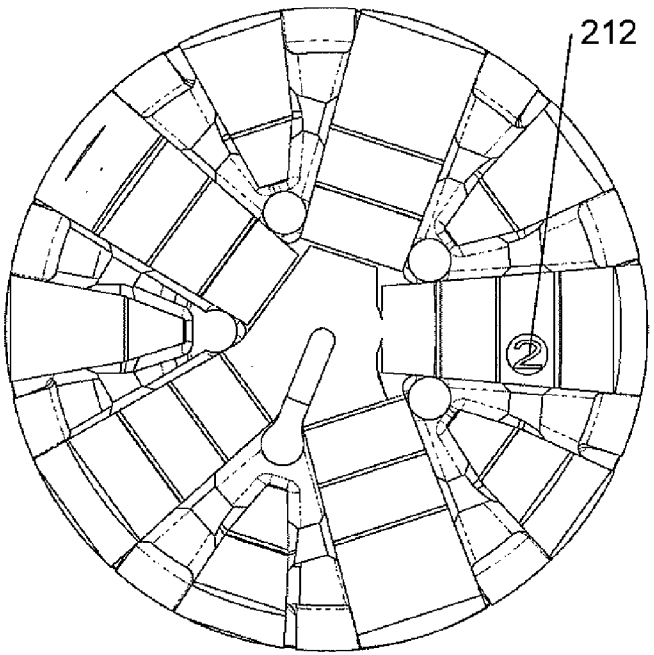
Figure 10:
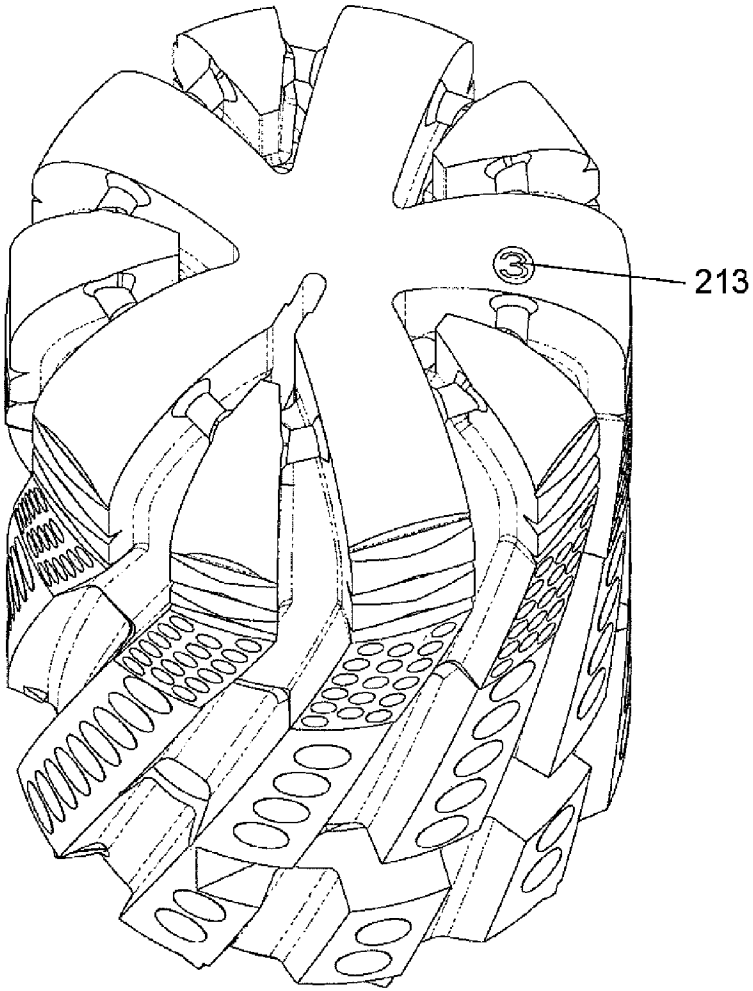
FIGS. 9 and 10 are similar respective ones of FIGS. 3 and 4 but illustrating level "3" wear.
Figure 9:
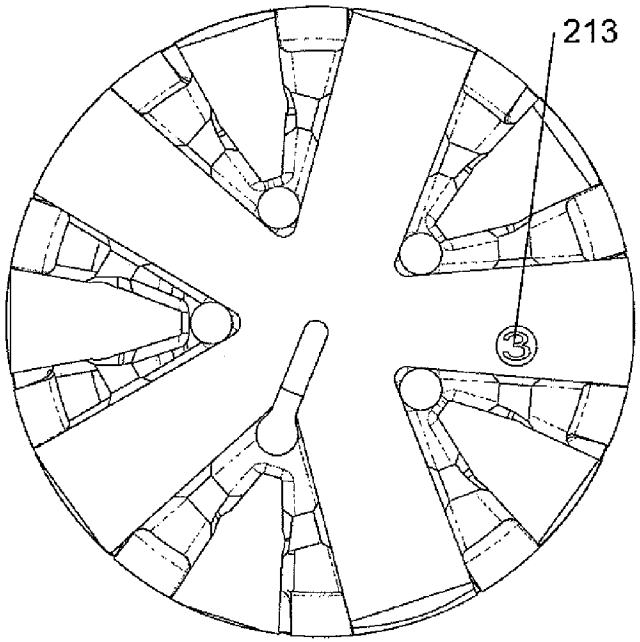
Figure 12:
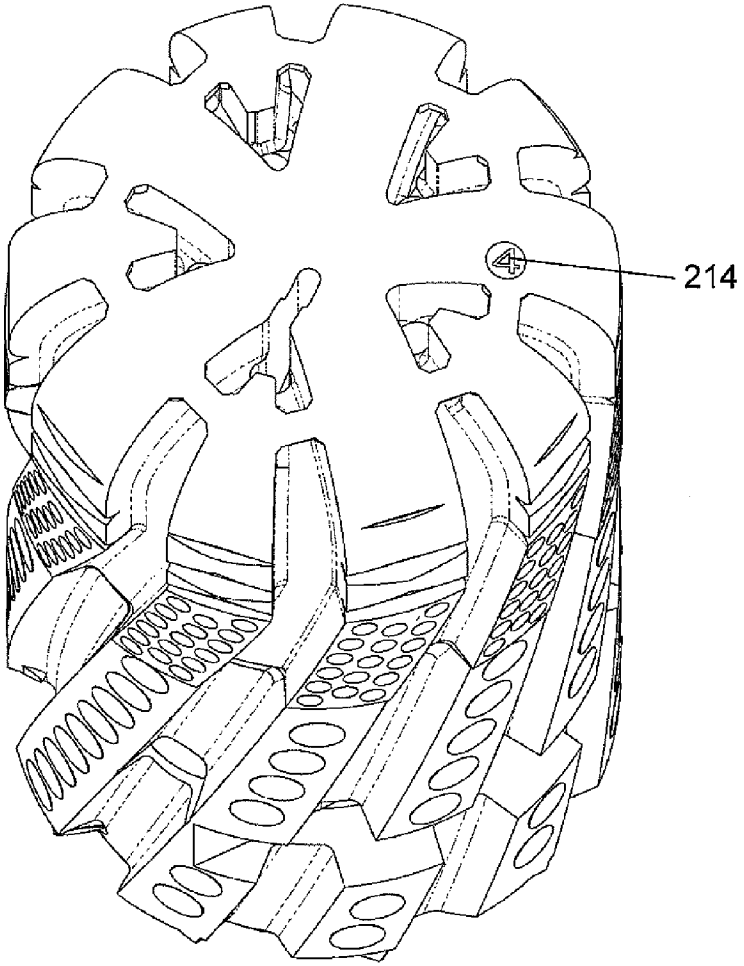
FIGS. 11 and 12 are similar respective ones of FIGS. 3 and 4 but illustrating level "4" wear.
Figure 11:
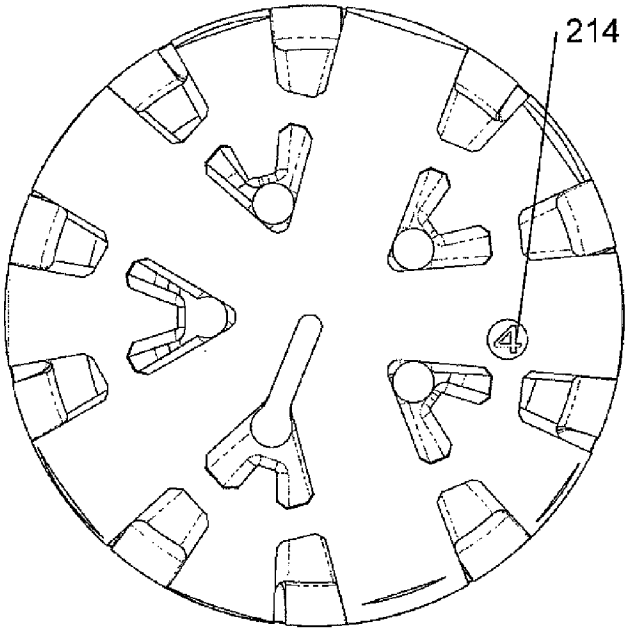
Figure 14:
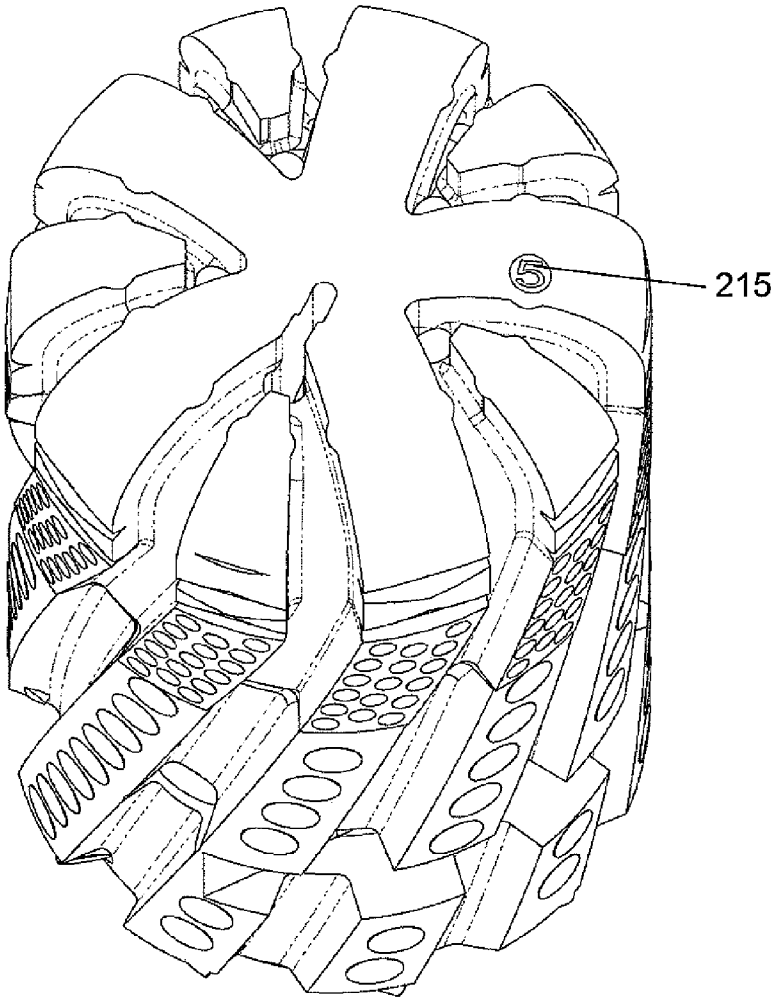
FIGS. 13 and 14 are similar respective ones of FIGS. 3 and 4 but illustrating level "5" wear
Figure 13:
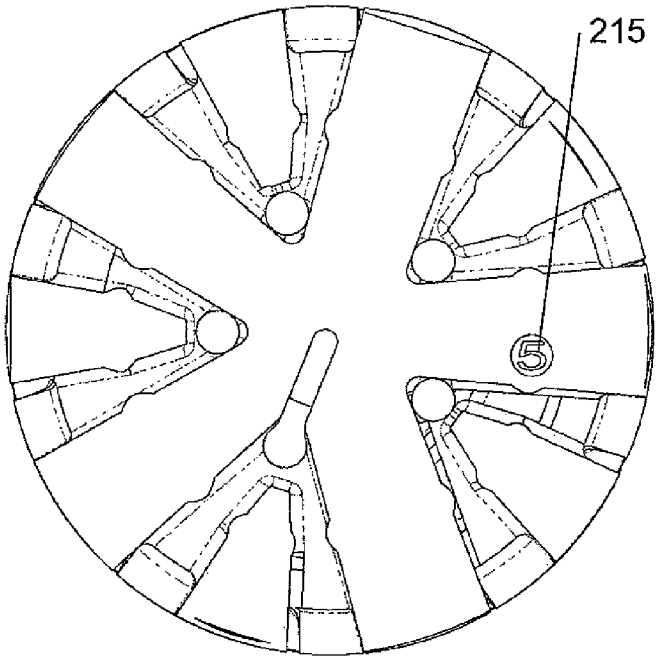
Figure 16:
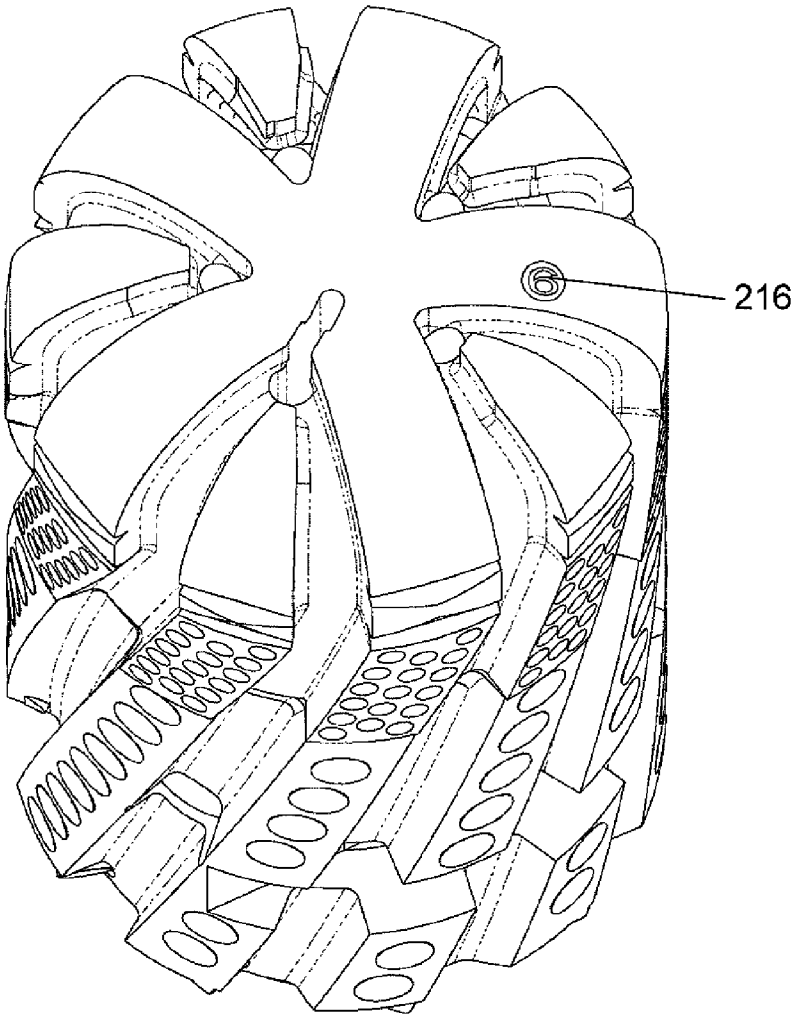
FIGS. 15 and 16 are similar respective ones of FIGS. 3 and 4 but illustrating level "6" wear.
Figure 15:
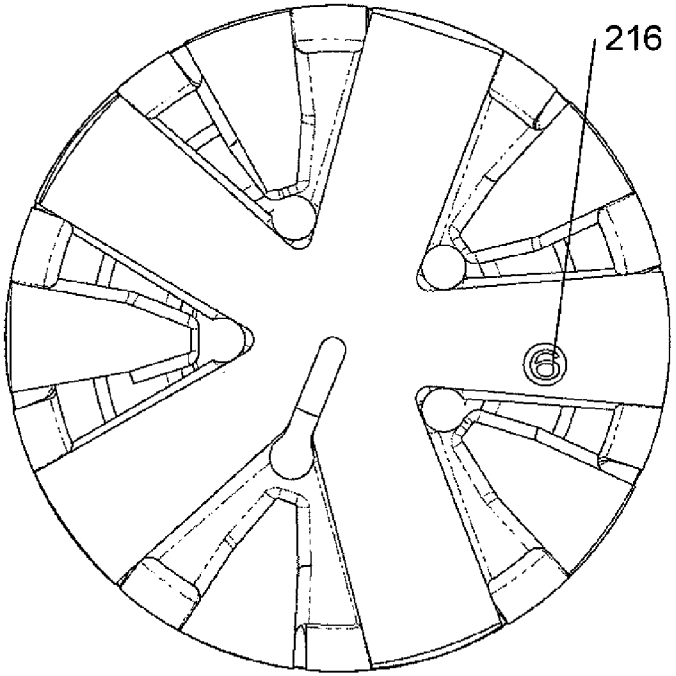
Figure 18:
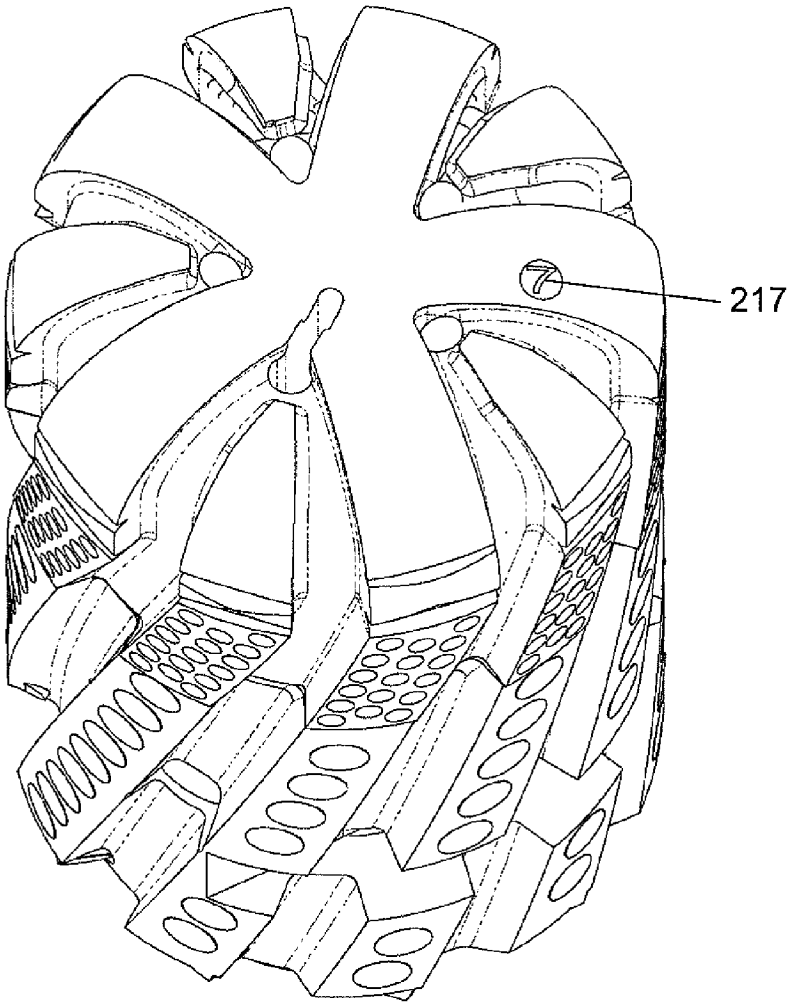
FIGS. 17 and 18 are similar respective ones of FIGS. 3 and 4 but illustrating level "7" wear.
Figure 17:
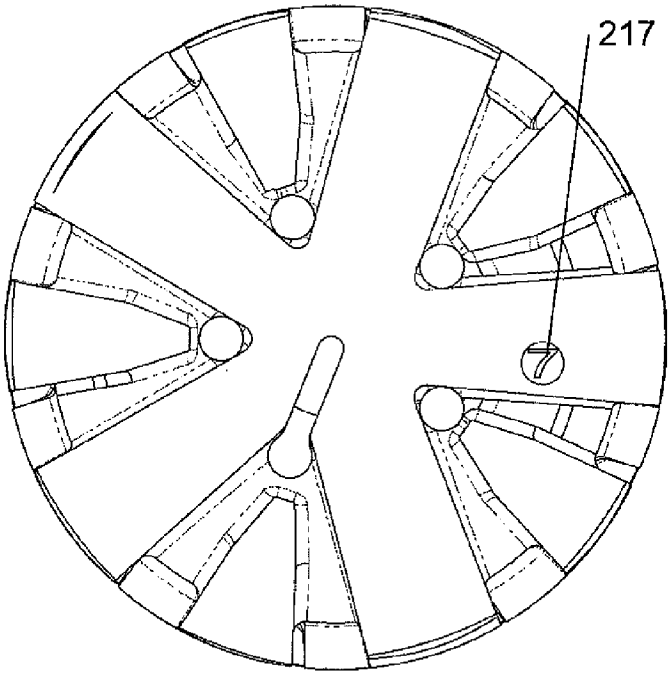
Figure 20:
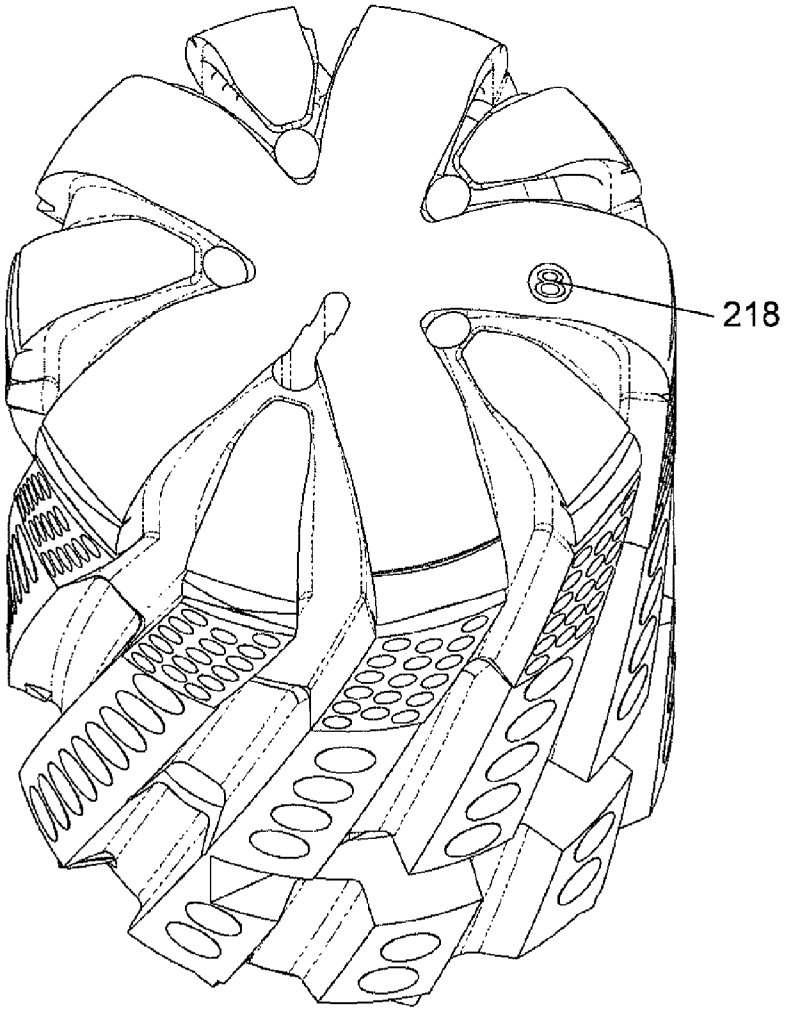
FIGS. 19 and 20 are similar respective ones of FIGS. 3 and 4 but illustrating level "8" wear.
Figure 19:
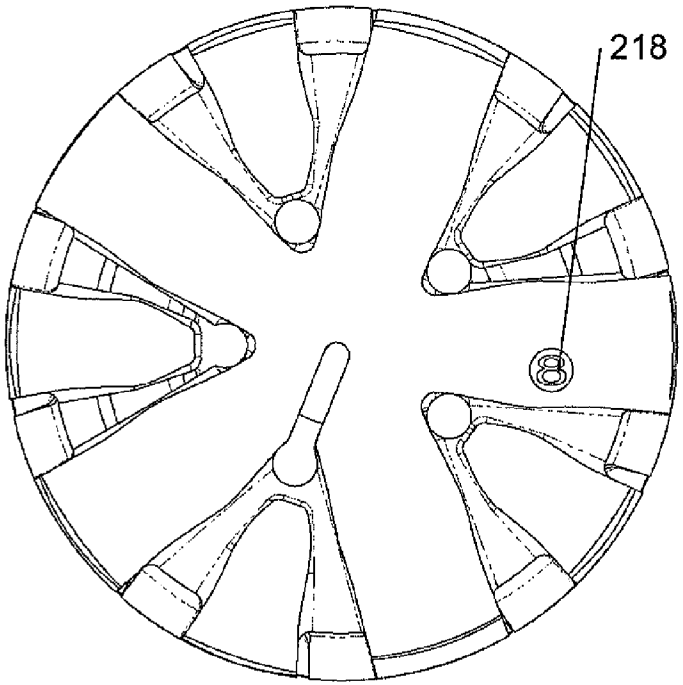

FIGS. 5 and 6 are similar to respective ones of FIGS. 3 and 4. Here, the drill bit has been worn to level "1" as indicated by wear indicator 211. Similarly, FIGS. 7 and 8 illustrate a drill bit that has been worn to level "2" as indicated by wear indicator 212; FIGS. 9 and 10 illustrate a drill bit that has been worn to level "3" as indicated by wear indicator 213; FIGS. 11 and 12 illustrate a drill bit that has been worn to level "4" as indicated by wear indicator 214; FIGS. 13 and 14 illustrate a drill bit that has been worn to level "5" as indicated by wear indicator 215; FIGS. 15 and 16 illustrate a drill bit that has been worn to level "6" as indicated by wear indicator 216; FIGS. 17 and 18 illustrate a drill bit that has been worn to level "7" as indicated by wear indicator 217; and FIGS. 19 and 29 illustrate a drill bit that has been worn to level "8" as indicated by wear indicator 218.

In each successive pairs of Figures, it can be seen that the cutting structure of the drill bit has been worn further when compared to the previous pairs of Figures.

Rapid prototyping and/or rapid manufacturing techniques can be used to the manufacture of wear indicators in accordance with the present invention. These techniques are well known and will not be described in detail here. By using such techniques, the wear indicator can be built up, layer by layer, under computer control so that the desired profiles are formed throughout the length of the wear indicator. These layers, which correspond to the virtual cross-section from the computer-aided design (CAD) drawing or model, are built automatically, step-by-step, in one piece to create the final shape. The primary advantage to additive fabrication is its ability to create almost any shape or geometric feature including internal voids.

In addition to being able to produce complex geometries, for example, the numbers in the wear indicators, these processes are energy efficient and have low material waste. Moreover, although they are not really "rapid", they provide time savings to be made as no subsequent processes are required.

Whilst rapid prototyping is the term given to the automatic construction of objects using additive manufacturing technology, the process can typically be used to manufacture production-quality parts when only small numbers are required. Rapid manufacturing, sometimes also termed, direct digital, direct, instant or on-demand manufacturing, is an extension of rapid prototyping and comprises manufacturing process in which additive and/or subtractive fabrication techniques can be used to create parts from three-dimensional models under computer control.

Typical materials that can be used for rapid prototyping and rapid manufacturing techniques include a variety of materials including metallic alloys, for example, steel, as well as, polymeric materials.

It will be appreciated that several wear indicators can be manufactured at the same time using either rapid prototyping or rapid manufacturing techniques in accordance with the particular apparatus that is employed. For example, it is possible to manufacture up to 50 wear indicators at a time.

As an alternative to using rapid prototyping or rapid manufacturing for the manufacture of wear indicators in accordance with the present invention, a wear indicator can be constructed as a plurality of segments, each segment having a different number formed through it. The segments are joined together, for example, by sintering, welding, brazing, gluing etc., to form a coherent wear indicator that can be inserted into a drill bit either during its manufacture, or at a later stage. Again, as the drill bit wears down, the relevant wear level number becomes visible.

The segments may be cast, extruded, moulded or made by any other suitable technique. Naturally, the manufacturing technique may depend on the material from which the wear indicator is made, for example, if aluminium is to be used, it can be extruded. Materials that can be used for making the segments include, and is not limited to, metals, metallic alloys, and ceramics. The segments may also be constructed using one of the matrix materials described below.

As described in US-A-2007/0215389, a matrix drill bit can be formed by placing metallic powder material with a binder in a mould. The mould and its contents are heated to allow the binder to flow into the metallic powder, which sets when subsequently cooled to form a drill bit. This type of drill bit is also known as a matrix body bit.

The mould may be formed by milling a block of material, such as graphite, to define a mould cavity with features that correspond generally with the exterior features of the resulting matrix drill bit. Diamond cutters or other abrasive materials are placed in the mould before the matrix materials are added.

Additional features can be formed in the matrix drill bit by shaping the mould cavity and/or placing displacement materials in predetermined locations within the cavity. A steel blank may be placed in the mould cavity to allow the subsequent attachment of the drill bit to a threaded shank.

Matrix materials include microcrystalline tungsten carbide, cast carbides, cemented carbides, spherical carbides, or any other suitable material or combination thereof. Cemented carbides include tungsten carbide (WC), molybdenum carbide (MoC), titanium carbide (TiC), tantalum carbide (TaC), niobium carbide (NbC) and solid solutions of mixed carbides such as, WC—TiC, WC—TiC—TaC, WC—TiC—(Ta/Nb)C in a metallic binder of copper, nickel, iron, molybdenum, cobalt or their alloys in powder form.

Binder materials include copper or copper-based alloys that include one or more of manganese, nickel, tin, zinc, silicon, molybdenum, tungsten and phosphorous.

Using the method of forming a matrix bit body described in US-A-2007/0215389, the wear indicator of the present invention can be inserted into the mould at a suitable location and retained in place whilst the matrix material is added and during the infiltration process.

Alternatively, displacement materials may be used to create a space in the drill bit into which the wear indicator can be inserted after moulding.

The wear indicator may be inserted into the drill bit or core head in several ways. For example, it may be glued, brazed, welded or screwed in position. The outer diameter of the wear indicator may be sized to be an interference fit with a hole formed in the drill bit, that is, the outer diameter of the wear indicator being slightly larger than the internal diameter of the hole into which it is to be inserted. In this instance, the wear indicator is simply inserted and retained in position due to the interference fit.

Whilst the present invention has been described with reference impregnated drill bits, it will be appreciated that it can also be applied to different drill bits, for example, PDC cutter bits. In the case of PDC cutter bits, the cutters are brazed on top of the bit head and the wear indicator may be inserted into one or more blades at a suitable position so that it can provide a correct indication of the wear level of that particular type of drill bit.

It will readily be understood that more than one wear indicator may be provided on each drill bit. In this case, each wear indicator provides an indication of the wear of that particular part of the drill bit and, when all the wear indicators on a drill bit are considered together, an overall indication of the wear pattern of the drill bit can be determined.

It will be appreciated that the wear indicator of the present invention is not limited to use on drill bits and/or core heads, but can be used in any application where a level of wear needs to be readily determined, for example, hole openers and bicentres.

The invention claimed is:

1. A wear indicator for drilling bits, the wear indicator comprising an elongate element having a plurality of regions formed along a length of the elongate element, each region having a number, formed as a void within the region that is indicative of the level of wear, and each region being formed as a discrete portion, the discrete portions held together to form the elongate element.

2. A wear indicator according to claim 1, wherein each number corresponds to a wear level in the International Association of Drilling Contractors dull grading system.

3. A wear indicator according to claim 1, wherein there are eight regions, each region being numbered between "1" and "8".

4. A wear indicator according to claim 1, wherein the void is filled with a different material than that of the elongate member.

5. A wear indicator according to claim 1, wherein the elongate element comprises a closed end that is indicative of no wear.

6. A wear indicator according to claim 1, wherein the number is visually distinct with respect to the elongate element.

7. A wear indicator according to claim 1, wherein the elongate element is substantially cylindrical.

8. A wear indicator according to claim 7, wherein the elongate element has a substantially circular cross-section.

9. A wear indicator according to claim 7, wherein the elongate element has a substantially elliptical cross-section.

10. A wear indicator according to claim 7, wherein the elongate element has a substantially rectangular cross-section.

11. A wear indicator according to claim 7, wherein the elongate element has a substantially polygonal cross-section.

12. A wear indicator according to claim 11, wherein the substantially polygonal cross-section comprises a regular polygon.

13. A wear indicator according to claim 12, wherein the regular polygon comprises a square.

14. A wear indicator according to claim 12, wherein the regular polygon comprises a triangle.

15. A wear indicator according to claim 12, wherein the regular polygon comprises a hexagon.

16. A wear indicator according to claim 1, wherein the discrete portions are fused together.

17. A wear indicator according to claim 1, wherein each region of the elongate element is formed consecutively in a continuous process.

18. A drill bit including a wear indicator according to claim 1.

19. A drill bit according to claim 18, wherein the wear indicator forms part of the drill bit following a moulding process.

20. A drill bit according to claim 19, wherein the moulding process comprises an infiltration process.

21. A core head including a wear indicator according to claim 1.

22. A core head according to claim 21, wherein the wear indicator forms part of the core head following a moulding process.

23. A core head according to claim 22, wherein the moulding process comprises an infiltration process.

* * * * *

UNITED STATES PATENT AND TRADEMARK OFFICE

CERTIFICATE OF CORRECTION

PATENT NO. : 9,022,143 B2
APPLICATION NO. : 13/513533
DATED : May 5, 2015
INVENTOR(S) : Olivier Dupont et al.

It is certified that error appears in the above-identified patent and that said Letters Patent is hereby corrected as shown below:

IN THE CLAIMS:

Claim 1, Column 7, line 25-31

Please remove the "," after "number" in line 28 so the claim may read as follows:

1. A wear indicator for drilling bits, the wear indicator comprising an elongate element having a plurality of regions formed along a length of the elongate element, each region having a number formed as a void within the region that is indicative of the level of wear, and each region being formed as a discrete portion, the discrete portions held together to 30 form the elongate element.

Signed and Sealed this
Eighth Day of September, 2015

Michelle K. Lee

Michelle K. Lee
*Director of the United States Patent and Trademark Office*